US006502800B1

(12) United States Patent
Ursini et al.

(10) Patent No.: US 6,502,800 B1
(45) Date of Patent: Jan. 7, 2003

(54) QUICK RELEASE EXTRUSION BRACKET WITH A SECURE LOCK

(75) Inventors: Joseph Ursini, Staten Island, NY (US); David Warren, Tillson, NY (US); Gustavo Cubillos, Staten Island, NY (US); Jorje Betancur, Staten Island, NY (US)

(73) Assignee: Majestic Industries, Inc., Passaic, NJ (US)

( * ) Notice: Subject to any disclaimer, the term of this patent is extended or adjusted under 35 U.S.C. 154(b) by 0 days.

(21) Appl. No.: 09/661,378

(22) Filed: Sep. 13, 2000

Related U.S. Application Data

(60) Provisional application No. 60/153,241, filed on Sep. 13, 1999.

(51) Int. Cl.[7] ..... A47B 97/00

(52) U.S. Cl. ..... 248/500; 248/501; 297/174

(58) Field of Search ..... 248/501, 506, 248/500, 510, 551, 553, 221.12, 221.11, 222.13, 222.11, 680, 681; 297/174, 217.1

(56) References Cited

U.S. PATENT DOCUMENTS

| | | | | | |
|---|---|---|---|---|---|
| 1,450,183 | A | * | 4/1923 | Moon | 248/680 |
| 4,840,343 | A | * | 6/1989 | Gasser | 248/500 |
| 5,102,192 | A | * | 4/1992 | Barile, Sr. | 297/257 |
| 5,114,112 | A | * | 5/1992 | Infanti | 248/500 |
| 5,232,191 | A | * | 8/1993 | Infanti | 248/500 |
| 5,409,296 | A | * | 4/1995 | Barlie | 297/344.1 |
| 5,542,748 | A | * | 8/1996 | Barlie | 297/463.1 |
| 5,791,731 | A | * | 8/1998 | Infanti | 297/217.3 |
| 6,089,651 | A | * | 7/2000 | Carmen | 297/16.1 |
| 6,354,660 | B1 | * | 3/2002 | Friedrich | 297/217.1 |

* cited by examiner

*Primary Examiner*—Leslie A. Braun
*Assistant Examiner*—Gwendolyn Baxter
(74) *Attorney, Agent, or Firm*—Dorsey & Whitney LLP

(57) ABSTRACT

A quick release extrusion bracket with a lock is provided. The quick release extrusion bracket secures a chair, stool, seat, etc. with a base plate at the end of a supporting post, leg, etc. to a floor. The quick release extrusion bracket enables the quick and easy release of the base plate from the bracket, thereby facilitating the simple and quick removal of the chair, stool, seat, etc. The lock enables the base plate to be locked to the bracket so that it may not be removed by a patron or other person without an appropriate tool or key.

22 Claims, 12 Drawing Sheets

QUICK RELEASE EXTRUSION BRACKET WITH A SECURE LOCK

CROSS-REFERENCE TO RELATED APPLICATIONS

The present application claims priority of Provisional Application No. 60/153,241, filed on Sep. 13, 1999, incorporated herein by reference as if fully set forth.

BACKGROUND OF THE INVENTION

1. Field of the Invention

The field of the present invention includes means of securing chairs and stools to specified positions on a floor.

2. Description of the Related Art

In order to prevent theft and inconvenient relocation by patrons of chairs and stools, many establishments such as restaurants, bars, casinos, entertainment venues and convention centers make use of chairs and stools that are fixed to the floor. However, in certain situations, it becomes necessary to move the chairs and stools to more convenient locations or to remove them completely. Examples of such situations include when the floor plan of the establishment is changed or when a handicapped patron wishes to use a wheelchair in lieu of the fixed stool or chair. If the chair is bolted to the floor, as is commonly done in establishments, the patron is either unable to place the wheelchair in the desired location or extensive labor is required to remove the chair.

As one possible alternative to bolting, it is known in the art to secure chairs and stools by the use of J-brackets. These J-brackets, illustrated in FIG. 1, effectively function as a hook 10 protruding from the floor 20 and secured thereto by a bracket 30. Such a hook can secure the position of a plate 40 having a lip 50. If a post 60 that supports a chair or stool (not shown) is attached to plate 40, post 60 provides a means of securing the chair while maintaining a method of removing the chair, should the need arise.

One drawback of the J-bracket discussed above is the need to re-adjust the brackets whenever the floor height changes, such as when the carpet of the establishment is replaced. This need arises from the fact that, when a thicker carpet is used, there may no longer be enough clearance to allow the lip 50 to fit into the hook 10 and, when a thinner carpet is used, the hook 10 may not extend far enough to contact the lip 50 and the chair would not be secured.

Another drawback of the J-bracket is that it includes no means for preventing unwanted removal of the chair by patrons.

Hence, what is needed is an apparatus for securing a chair that allows for a convenient removal of the chair from a particular location. What is needed is an apparatus for securing a chair that is not dependent on a constant thickness of the carpet to operate properly.

What is also needed is an apparatus for securing a chair that prevents unwanted removal of the chair from the apparatus.

SUMMARY OF THE INVENTION

Certain embodiments of the present invention provide an apparatus that secures a chair to a fixed location relative to a floor, that allows for the convenient removal of the chair from the fixed location and that does not require readjustment when the relative height of the floor to which the apparatus is attached changes.

Certain other embodiments of the present invention provide the three advantages listed immediately above and also restrict unwanted removal of the chair from the apparatus.

Certain other embodiments of the present invention provide a quick-release securing mechanism, including a base, a first tongue, extending substantially perpendicularly from the base, a back piece, extending perpendicularly from the base in a same direction as the first tongue and a stop extending perpendicularly from the back piece and towards the first tongue.

Other aspects and advantages of the present invention will become apparent from the following detailed description, which, when taken in conjunction with the accompanying drawings, illustrates by way of example the principles of the present Invention.

Same numerals in FIGS. 1–8 are assigned to similar elements in all the figures. Embodiments of the present invention are discussed below with reference to FIGS. 1–8. However, those skilled in the art will readily appreciate that the detailed description given herein with respect to these figures is for explanatory purposes as the present invention extends beyond these limited embodiments.

DETAILED DESCRIPTION OF THE INVENTION

Figure 1:
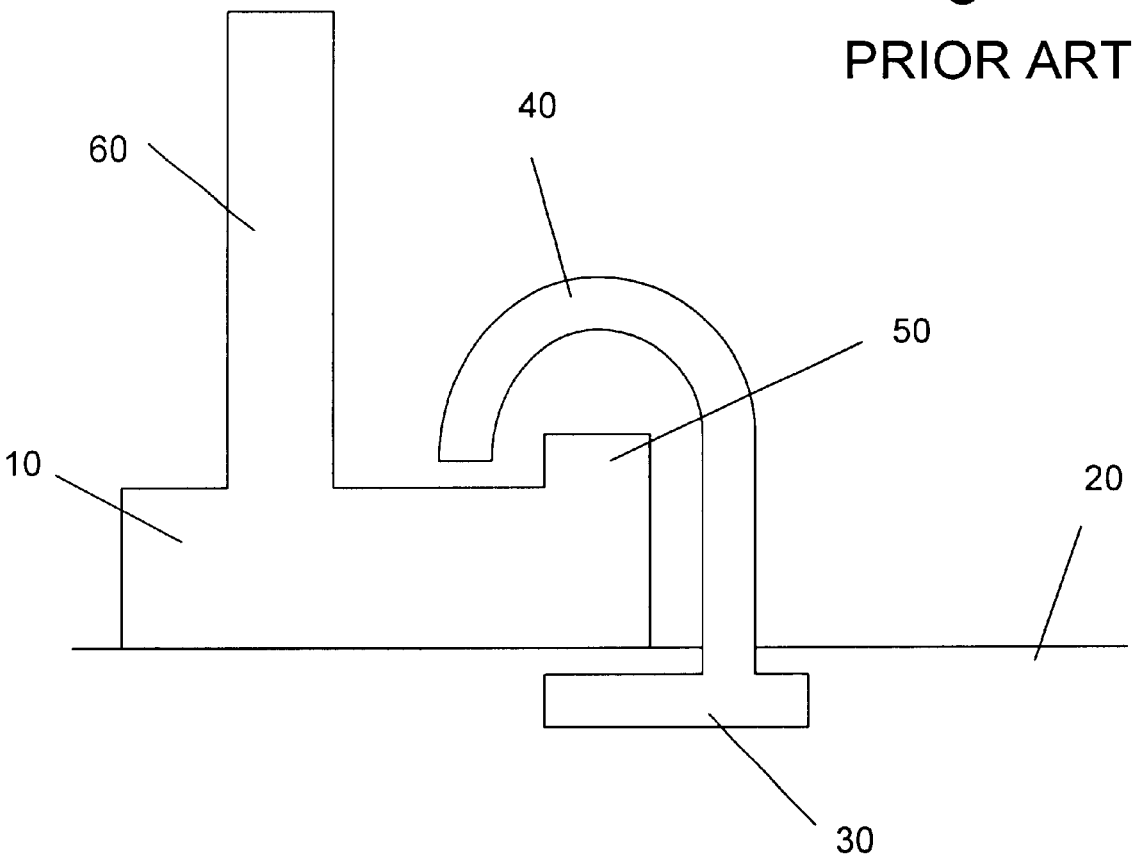
Fig. 1 PRIOR ART
FIG. 1 illustrates a side-view of a J-bracket securing a plate to which a seat post is attached.
Figure 2:
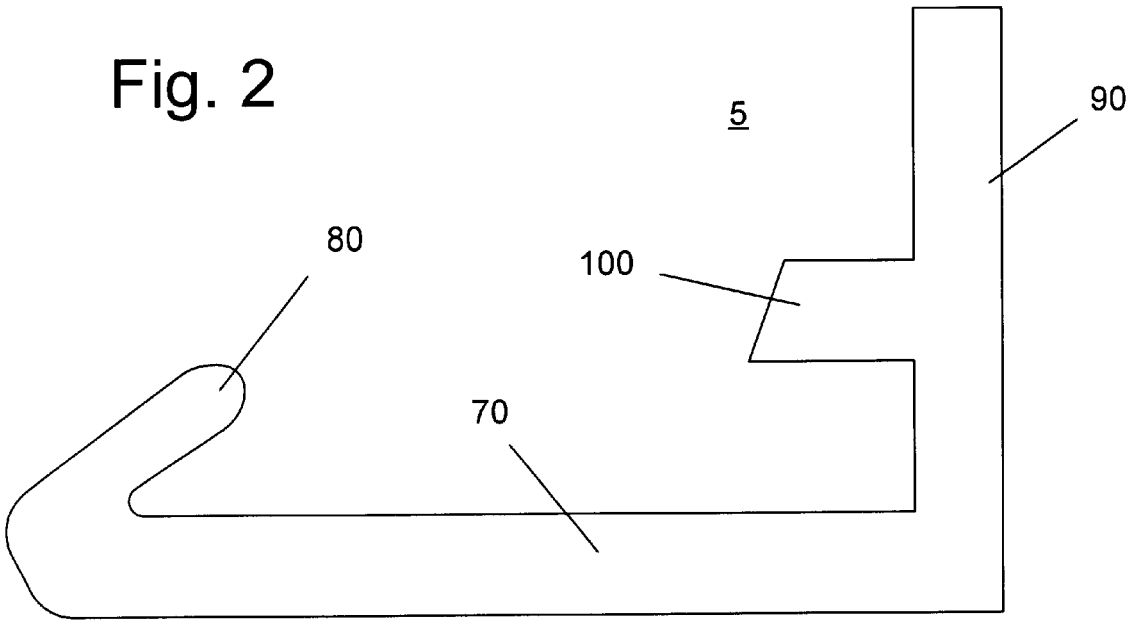
FIG. 2 illustrates a side view of a bracket according to embodiments of the present invention.

FIG. 2, illustrates a bracket 5 according to certain embodiments of the present Invention. As is seen, bracket 5 includes a base 70 that is generally, though not exclusively, positioned and secured horizontally to a floor of an establishment such as a casino, bar, entertainment venue, etc., while in use. Bracket 5 also includes a tongue 80 and a back piece 90 protruding substantially perpendicularly from base 70. Tongue 80 and back piece 90 are generally, though not exclusively, located at opposite ends of bracket 5 and both are on the same side of base 70, protruding away from the floor upon which bracket 5 may be secured. Stop 100 protrudes from back piece 90, above and substantially parallel to base 70 and towards tongue 80. Although the present Invention is not particularly limited to specific dimensions tongue 80 may be approximately six inches wide.

Figure 3:
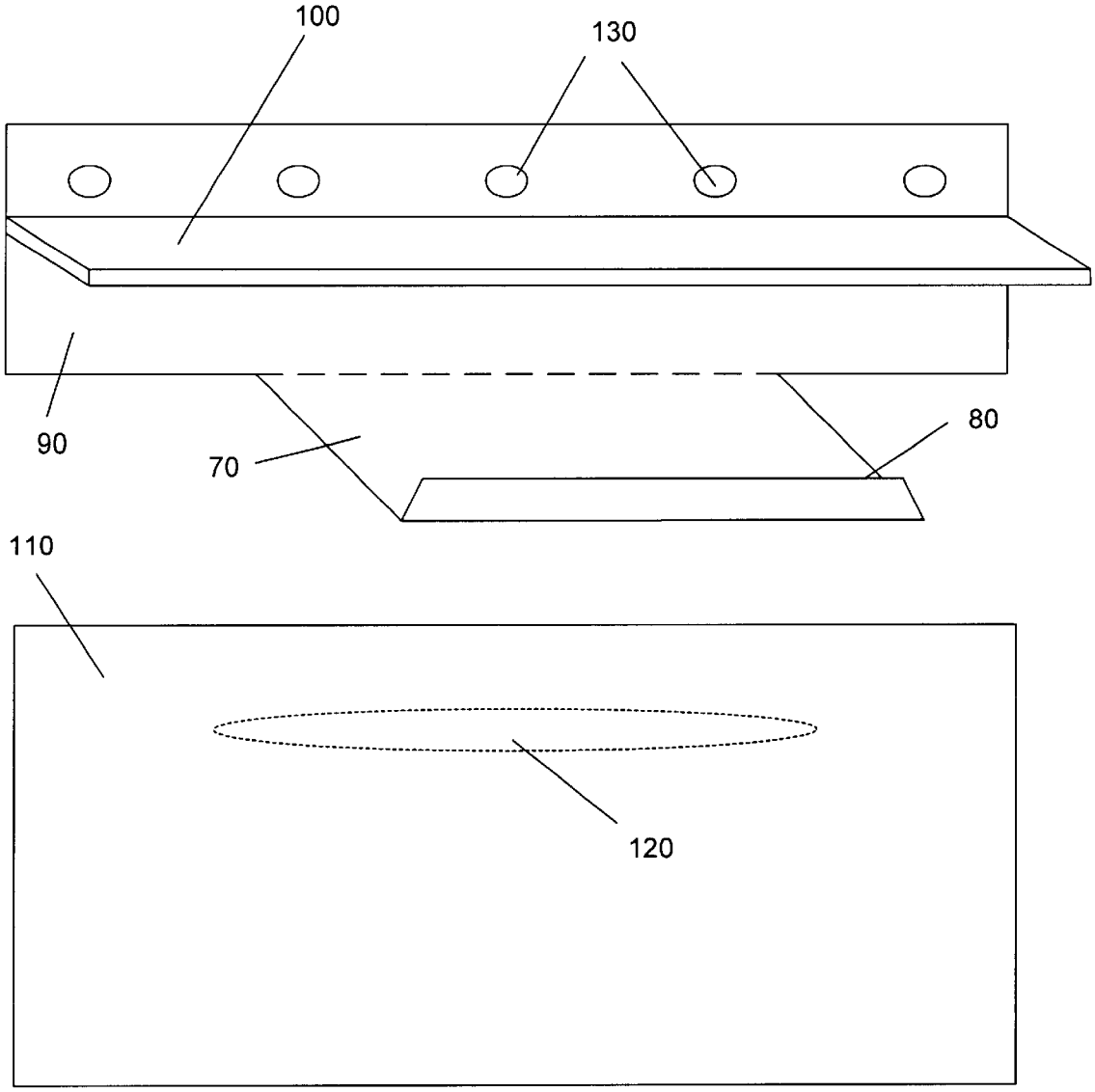
FIG. 3 illustrates a three-dimensional view of a bracket according to embodiments of the present invention and a base plate, within the scope of some embodiments of the present invention, that is secured by the bracket.

FIG. 3 shows an embodiment of bracket 5 from a three-dimensional perspective and further illustrates how bracket 5 can be positioned relative to base plate 110. Base plate 110 comprises a groove 120 at least on one side thereof. According to some embodiments of the present Invention, groove 120 may extend completely through base plate 110, thereby providing a slit or hole (not shown) through base plate 110. Although no particular dimensions are specific to the present Invention, according to certain embodiments of the present Invention, groove 120 may be approximately six inches long (corresponding roughly to the length of tongue 80 and capable of receiving tongue 80) and located substantially in the center of base plate 110. Base plate 110 may typically be between eleven or fifteen inches wide.

When in a secured position, a portion of base plate 110 is in direct contact with the top surface of base 70 and tongue 80 is positioned under and/or in groove 120 (or through groove 120 if the groove to be provided is a slit or hole). In this secured position, base plate 110 is prevented from substantially moving in horizontal directions by tongue 80 and back piece 90. Base plate 110 is also prevented from substantially moving in a vertical direction by base 70 and stop 100. Once base plate 110 is in a secured position, base plate 110 may be removed from bracket 5 by lifting the end of base plate 100 not adjacent to bracket 5, moving base plate 110 in a direction diagonally upwards from base 70 and towards back piece 90, in order to clear tongue 80, and away from back piece 90, in order to clear stop 100.

FIG. 3 also illustrates a plurality of screw holes 130 in back piece 90 that provide for ease of attachment of bracket 5 to a wall or other vertical surface. It should be noted that, according to other embodiments of the present Invention, screw holes 130 may be placed at other locations on bracket 5 and that bracket 5 may be fixed in a location according to methods other than the use of screws. For example, base 70 may include securing devices (holes for screws, bolts, etc,.) that enable base 70 to be secured to a floor.

Although not illustrated, base plate 110 may further include, protruding substantially vertically from base plate 110, a post upon which a seat or stool can be attached, or other means for securing a seat, chair, stool, etc. to the base plate. Accordingly, the present Invention, enables a chair, seat or stool to be secured to a fixed location relative to a floor. Use of the present invention also allows for the convenient removal of the chair from the fixed location and does not require readjustment of the bracket when the relative height of the floor, to which the apparatus according to these embodiments is attached, changes. The latter is true because the operation of bracket 5 depends on the relative positioning of the components of bracket 5, not on the relative position of the floor and the apparatus. In other words, although the relative position of the floor/carpet can affect the functionality of a J-bracket by providing too much or too little clearance to insert plate 40 (as discussed above), an altered floor height does not affect the functionality of bracket 5 because base plate 110 is secured by the relative positions of base 70, tongue 80, stop 100 and back piece 90 to each other. The raising or lowering of bracket 5, for example, as caused by altered floor height due to plusher carpet, does not change these relative positions.

Figure 4A:
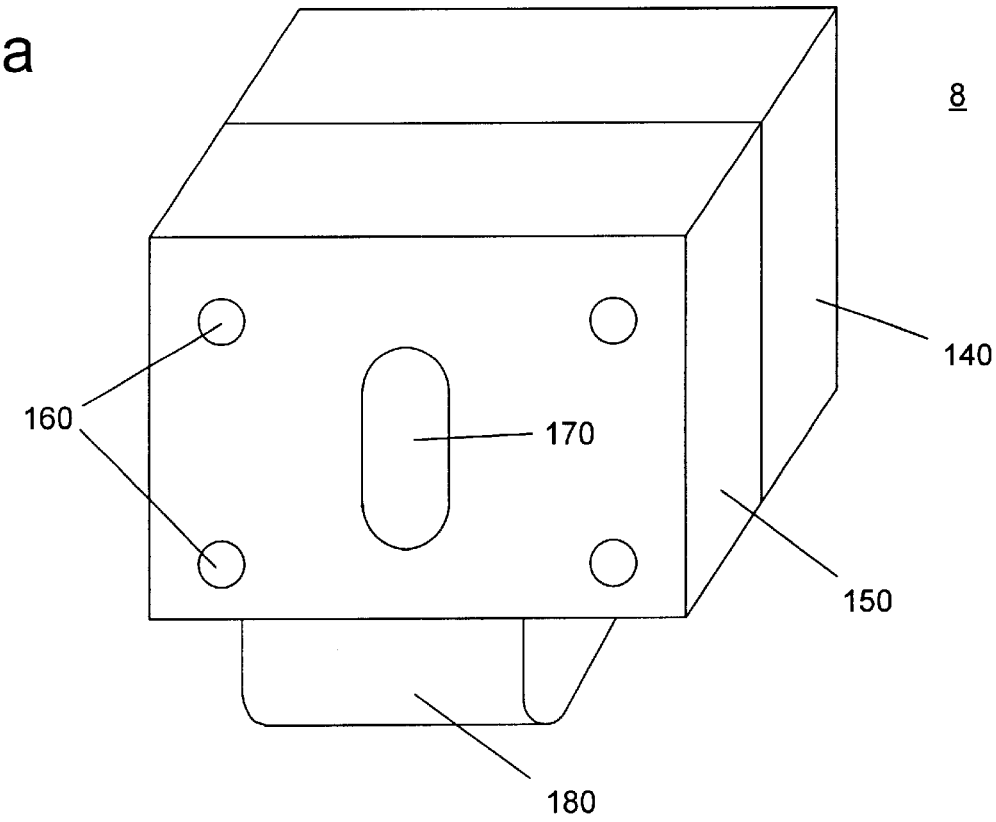
FIGS. 4*a*–4*e* illustrate a lock assembly used, according to some embodiments of the present invention, in conjunction with the bracket and base plate illustrated in FIG. 3.

FIGS. 4*a*–4*e* illustrate a lock assembly 8, according to certain embodiments of the present Invention, for locking base plate 110 to bracket 5. Specifically, FIG. 4*a* illustrates lock assembly including a back plate 140, a front plate 150, screws 160 securing back plate 140 to front plate 150, a slot 170, substantially in the middle of front plate 150 and extending through front plate 150, and a latch 180, a portion of which is seen protruding below front plate 150. Not shown in FIG. 4*a* is a cavity 190, formed between back plate 140 and front plate 150. Slot 170 provides access to cavity 190 and a portion of latch 180 that extends into cavity 190.

Figure 4B:
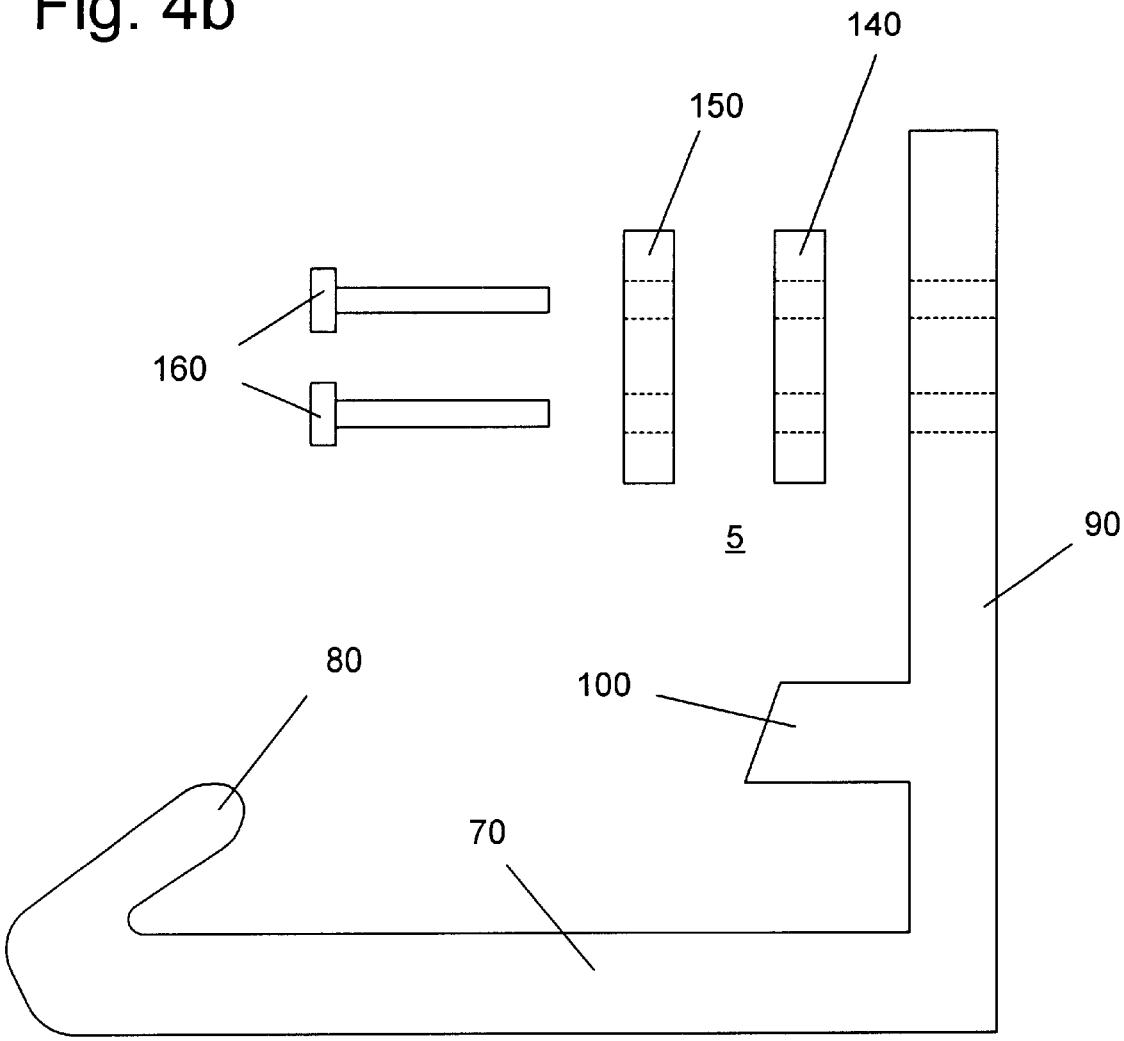

FIG. 4*b* illustrates how back plate 140 and front plate 150 may be secured to bracket 5 by screws 160. Other devices for securing lock assembly 8 to bracket 5 may be used.

Figure 4C:
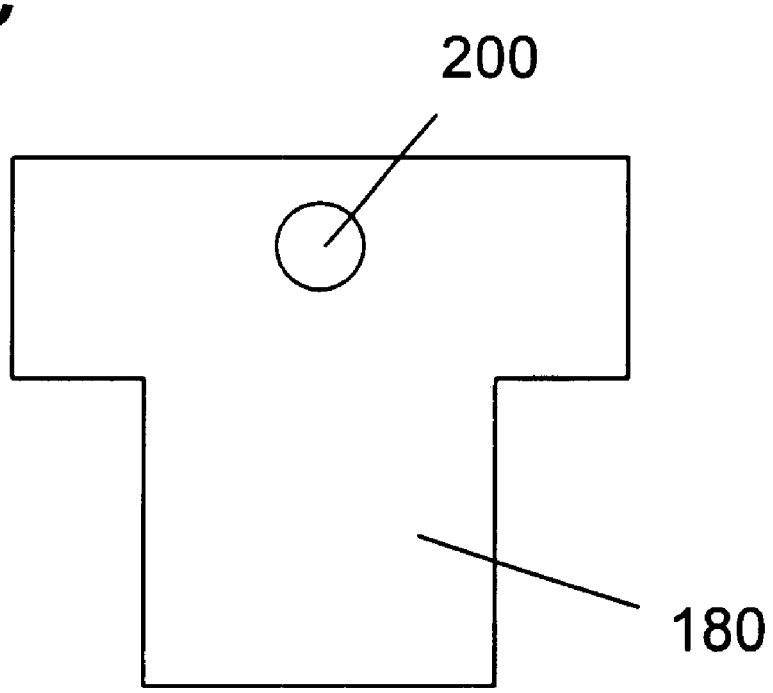
Figure 4D:
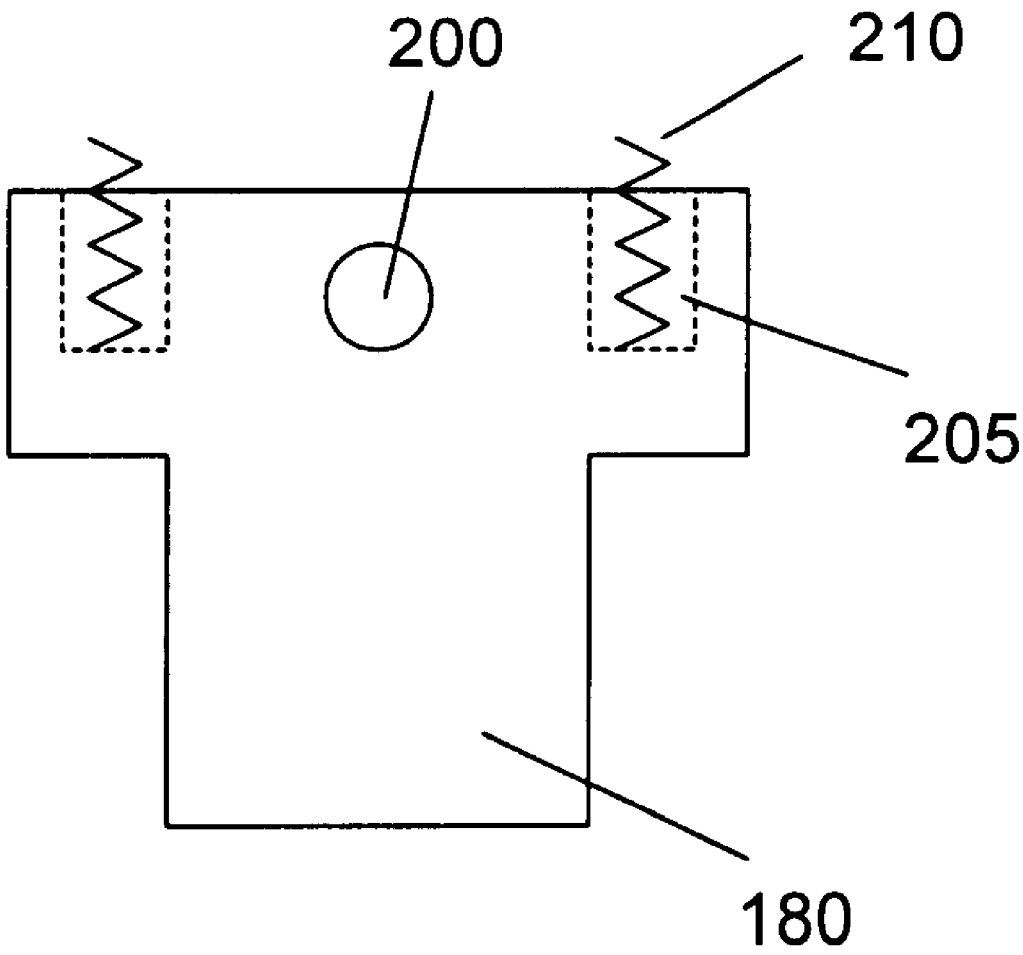
Figure 4E:
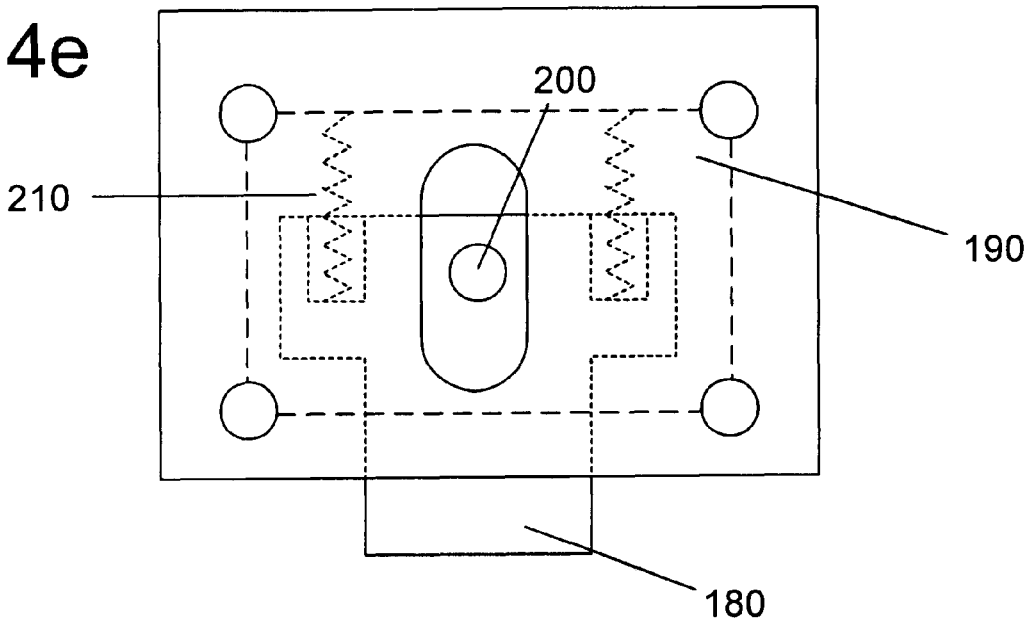

FIG. 4*c* illustrates latch 180 including the portion of latch 180 that resides in cavity 190. Latch 180 includes an eyelet 200 and one of more cavities 205 (shown in FIG. 4*d*) that may contain one or more springs 210 (also shown in FIG. 4*d*). Springs 210 exert a downward force against latch 180 and an upward force against the top of cavity 190 as illustrated in FIG. 4*e*.

Latch 180 is moveable between a first position and a second position. In the first position, springs 210 are extended and latch 180 extends beyond the edge of front plate 150 closest to base 70. In the second position, springs 210 are compressed and latch 180 does not extend beyond the edge of front plate 150 closest to base 70.

One method of moving latch 180 between the illustrated first position and second position is by inserting an item, such as a screwdriver, into slot 170 and into eyelet 200, exerting a force counter to springs 210 and moving latch 180 upwards away from base 70. As will be shown in FIG. 5, this is one method of moving certain embodiments of the present Invention between locked and unlocked positions, corresponding to the first and second positions, respectively.

Figure 5:
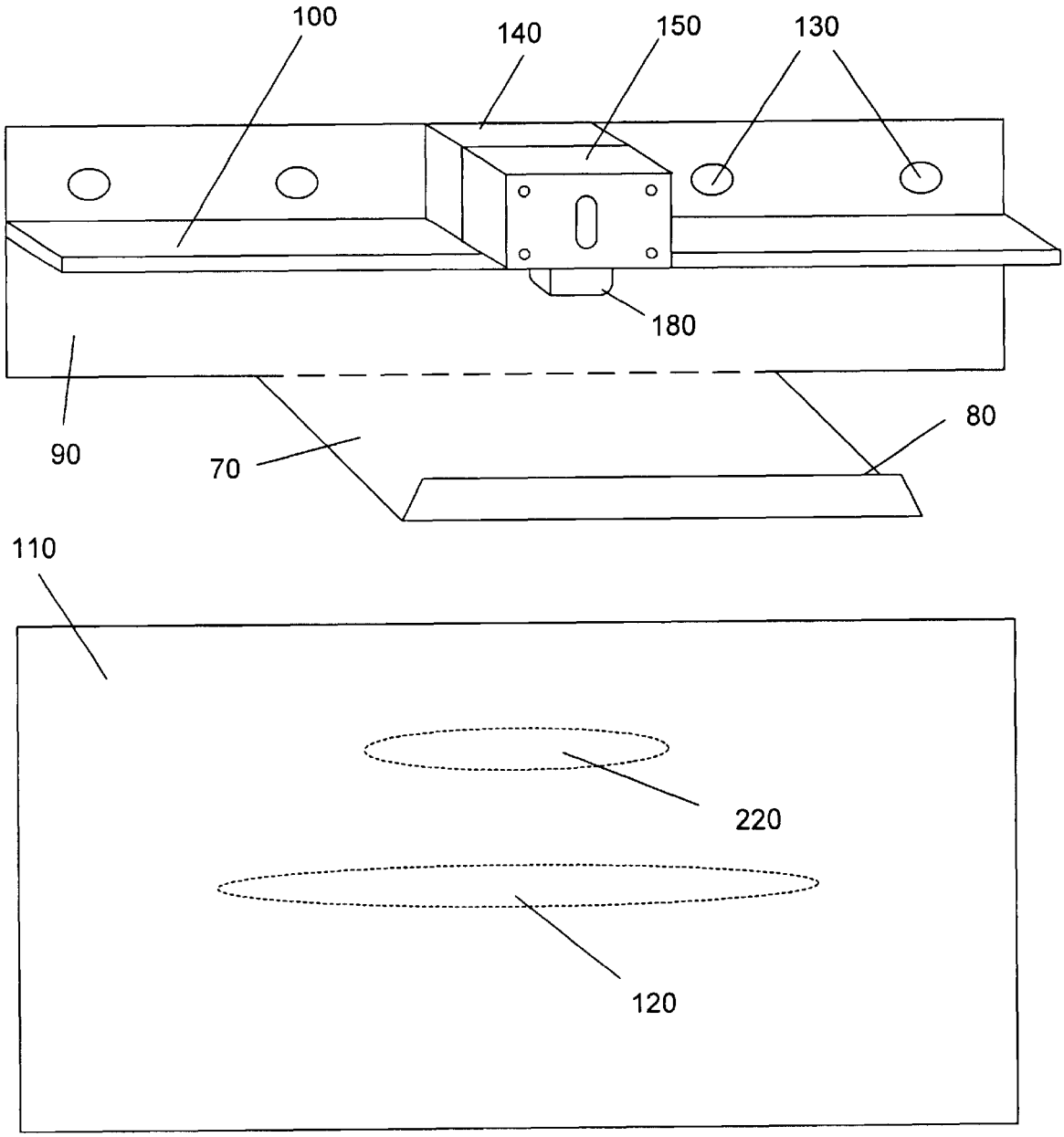
FIG. 5 illustrates a three-dimensional view of the bracket, base plate and lock assembly of an embodiment of the present invention.

FIG. 5 provides a three-dimensional view of embodiments of the present Invention in which lock assembly 8, illustrated in FIGS. 4*a*–4*c*, is attached to bracket 5. The view presented in FIG. 5 is one where tongue 180 is in the locked position. FIG. 5 also illustrates that, in the embodiments of the present Invention illustrated therein, base plate 110 contains an indentation 220 that, like groove 120, may extend completely through base plate 110.

Figure 6:
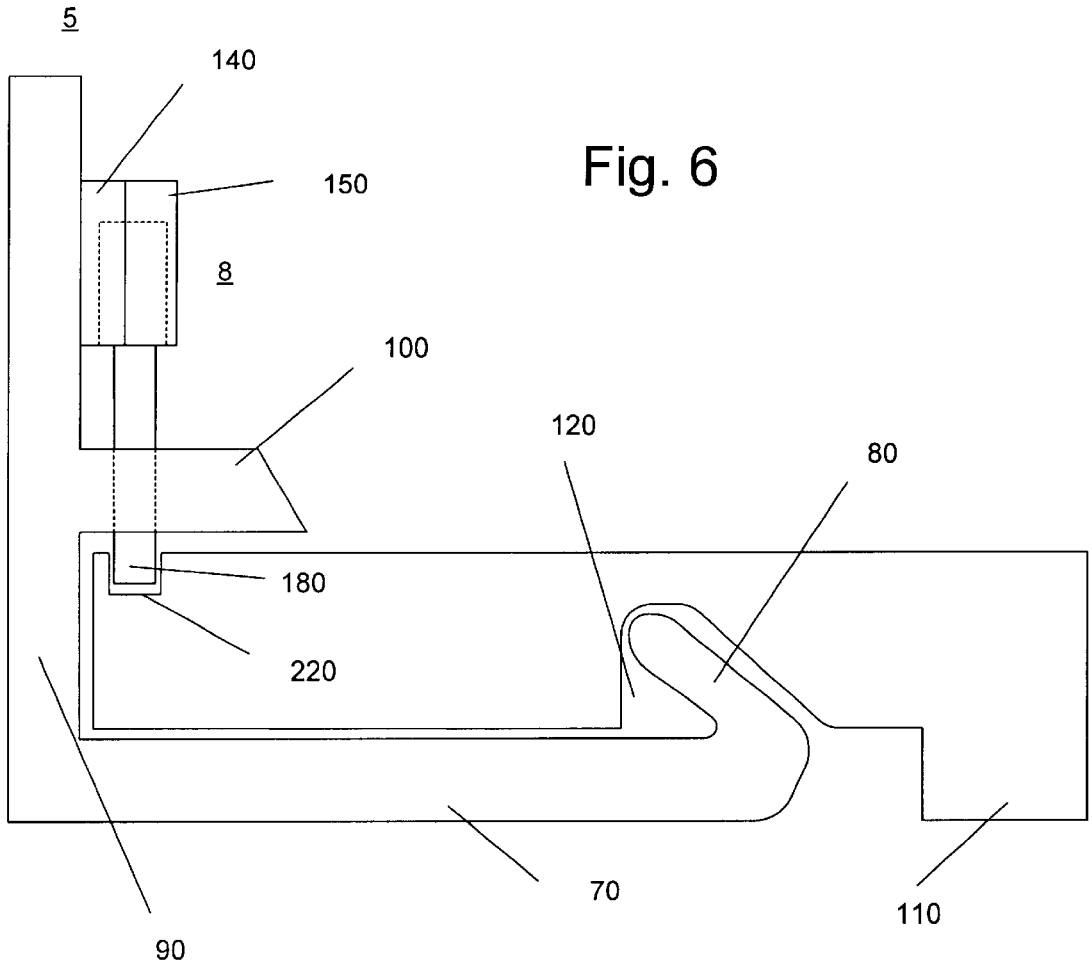
FIG. 6 illustrates a side view of a bracket, lock assembly and base plate of an embodiment of the present invention in a locked configuration.

As shown in FIG. 6, base plate 110 may be inserted into bracket 5 such that tongue 80 is inserted into groove 120. Base plate 110 is restricted from moving in the horizontal and vertical directions by bracket 5. Although the use of lock assembly 8 and presence of indentation 220 are purely optional, with lock assembly 8 in place (or in use), as is also shown in FIG. 6, base plate 110 is restricted from being removed from bracket 5. Specifically, when latch 180 extends beyond front plate 150, latch 180 inserts itself into indentation 220. Hence, any movement of base plate 110 perpendicular to or upwards from base 70 is substantially prevented unless latch 180 is pushed back into cavity 190 and no longer extends beyond front plate 150. As described above, this may be done simply by inserting a screwdriver into slot 170 and into eyelet 200 and exerting an upward force against latch 180.

It should be noted that, although latch 180 is represented as traveling through stop 100 before inserting into indentation 220 in FIG. 6, according to certain embodiments of the present Invention, lock assembly 8 and/or stop 100 may be modified such that latch 180 does not intersect or travel through stop 100. For example, back plate 140 may be made much thicker, allowing latch 180 to be further away from back piece 90. In such embodiments, indentation 220 would be located further away from back piece 90 to accommodate latch 180. Also, according to other embodiments of the present invention, lock assembly 8 may be positioned either in direct contact with stop 100 and, according to yet other embodiments, stop 100 is partially indented to allow lock assembly 8 to be positioned even closer to base 70.

Among the advantages of the embodiments of the present Invention that are illustrated in FIGS. 5 and 6 is that lock assembly 8 illustrated in FIGS. 4*a*–4*c* prevents unwanted persons from removing base plate 110 and any chairs or stools that are either directly or indirectly mounted thereto. However, an authorized person with a screwdriver or other device capable of being inserted into slot 170 and eyelet 200 and of raising latch 180 into cavity 190, can easily remove base plate 10 and the mounted chair or stool. This facilitates the simple, easy and quick removal of the mounted chair or stool.

Also within the scope of the present Invention are locking devices that prevent removal of base plate 110 even with a readily available device such as a screwdriver and instead require a key or combination. For example, a bicycle-type lock may be inserted in slot 170 to prevent access to eyelet 200.

Figure 7:
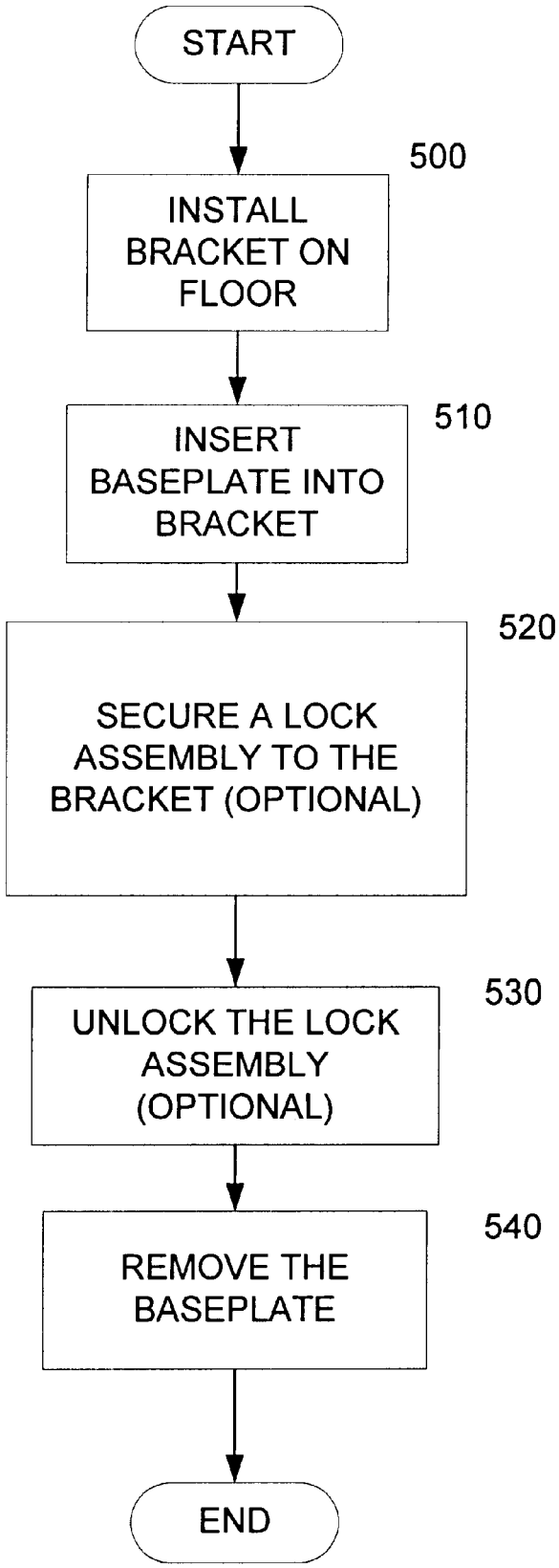
FIG. 7 illustrates a flowchart of a method of securing and removing a base plate.

FIG. 7 illustrates a flowchart of an exemplary method of use of the present invention including securing and removing a base plate (to which a chair, stool, seat, etc. is attached) to a fixed position on a floor. The steps of the method include: installing a bracket on a floor 500, inserting a baseplate into the bracket 510, optionally securing a lock assembly to the bracket 520, optionally unlocking the lock assembly 530 and removing the base plate 540. All of these steps may be executed as described above.

EXAMPLE

Figure 8:
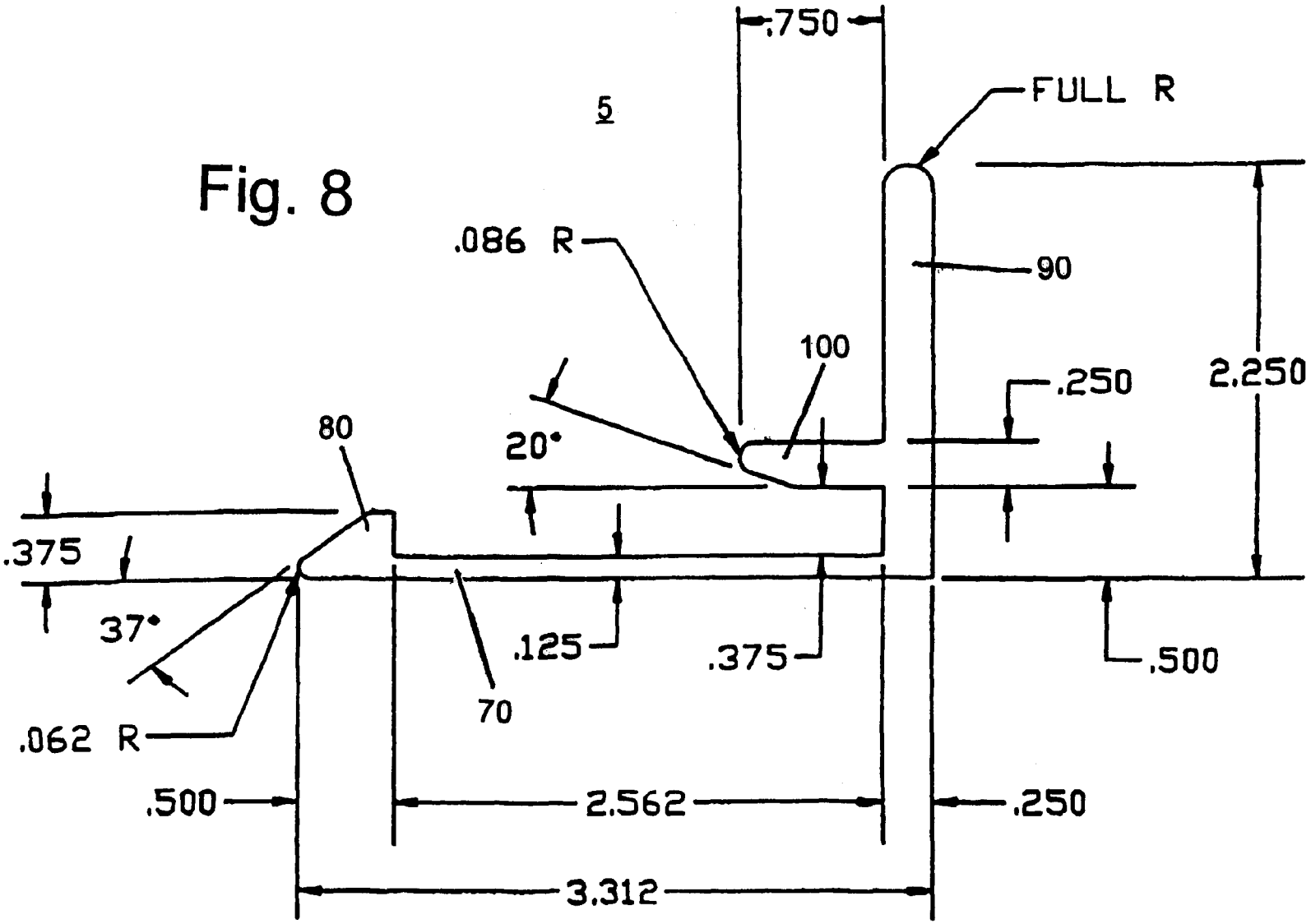
FIG. 8 illustrates an embodiment of a bracket according to the present invention wherein the dimensions of all of the illustrated components are provided.

Although in no way limiting of the present Invention, FIG. 8 provides some dimensions of one embodiment of a bracket included within the scope of the present Invention.

What is claimed is:

1. A quick-release securing mechanism, comprising:

a bracket including:

a base;

a tongue, extending perpendicularly from the base;

a back piece, extending perpendicularly from the base in a same direction as the tongue; and a stop extending perpendicularly from the back piece and towards the tongue; and a plate including;

a top and a bottom surface, a front edge and a back edge, and a groove in the bottom surface, the plate being movable between a first position in which the plate is engaged with the bracket, wherein at least a portion of the front edge of the plate is substantially adjacent to the back piece, wherein the tongue substantially extends into the groove, and wherein at least a portion of the top surface is substantially under the stop, and a second position wherein the plate is disengaged from the bracket.

2. The mechanism of claim 1, wherein the back piece is on an opposite end of the base from the tongue.

3. The mechanism of claim 1, wherein the groove extends through the plate.

4. The mechanism of claim 3, wherein, in the first position, the tongue extends through the groove and the plate.

5. The mechanism of claim 1, further comprising:

a lock assembly, attached to the bracket, that renders the plate substantially immovable while the plate is in the first position and the lock assembly is in a locked position.

6. The mechanism of claim 5, wherein the lock assembly can only be unlocked by use of a key or combination.

7. The mechanism of claim 5, wherein the lock assembly comprises:

a back plate attached to the bracket;

a front plate attached to the back plate;

a cavity formed by the back plate and the front plate and located between the plate and the front plate;

a slot located in and extending through the lock assembly and to the cavity, wherein the slot provides access to the cavity; and a latch moveable within the lock cavity between a locked and an unlocked position, the latch comprising an eyelet positioned on the latch and accessibly through the slot.

8. The mechanism of claim 7, wherein in the locked position the latch extends beyond a bottom edge of the front plate and secures the plate in the bracket in the first position and in the unlocked position the latch does not secure the plate in the bracket in the first position.

9. The mechanism of claim 8, wherein, when in the locked position, the latch fits into an indentation on the base plate.

10. The mechanism of claim 9, wherein the indentation extends through the base.

11. The mechanism of claim 10, wherein the latch, when in the locked position, extends through the indentation and through the base.

12. The mechanism of claim 8, wherein the latch does not extend beyond the bottom edge of the front plate when in the unlocked position.

13. The mechanism of claim 7, wherein the latch can be moved to the unlocked position by any device capable of being inserted into the slot and the eyelet and capable of transfering enough force to move the latch from the locked to the unlocked position.

14. The mechanism of claim 7, wherein the latch further includes at least one spring cavity with at least one spring that positions the latch in the locked position and exerts a force that resists movement of the latch into the unlocked position.

15. The mechanism of claim 14, wherein the spring exerts a force against a top surface of the cavity that positions the latch in the locked position.

16. A quick-release securing mechanism, comprising:

a bracket including;

a base, a tongue, extending perpendicularly from the base, a back piece, extending perpendicularly from the base in a same direction as the tongue, and a stop extending perpendicularly from the back piece and towards the tongue, and a plate including, a top and a bottom surface, a front edge and a back edge, and a groove in the bottom surface, the plate being movable between a first position in which the plate is engaged with the bracket wherein at least a portion of the front edge of the plate is substantially adjacent to the back piece, the tongue substantially extends into the groove and at least a portion of the top surface is substantially under the stop and a second position wherein the plate is disengaged from the bracket.

17. The mechanism of claim 16, further comprising:

a lock assembly, attached to the bracket, that renders the plate substantially immovable while the plate is in the first position and the lock assembly is in a locked position, the lock assembly including;

a back plate attached to the bracket;

a front plate attached to the back plate;

a cavity formed by the back plate and the front plate and located between the plate and the front plate;

a slot located in and extending through the lock assembly and to the cavity, wherein the slot provides access to the cavity; and a latch moveable within the cavity between a locked and an unlocked position, the latch comprising an eyelet positioned on the latch and accessibly through the slot.

18. A method of securing a seat to a fixed location comprising:

providing a seat that includes a baseplate at the bottom thereof, wherein the baseplate includes; a top and a bottom surface, a front edge and a back edge, and a groove in the bottom surface;

installing a bracket at a predetermined location on a floor, wherein the bracket includes; a base, a tongue extending perpendicularly from the base, a back piece extending perpendicularly from the base in a same direction as the tongue, and a stop extending perpendicularly from the back piece and towards the tongue; and inserting the baseplate into the bracket so as to allow the baseplate to be movable between a first position in which the baseplate is engaged with the bracket, at least a portion of the front edge of the baseplate is substantially adjacent to the back piece, the tongue substantially extends into the groove, and at least a portion of the top surface is substantially under the stop, and a second position wherein the plate is disengaged from the bracket.

19. The method of claim 18, further comprising:

securing a lock assembly to the bracket.

20. A quick-release securing mechanism, comprising:

a bracket including:

a base;

a tongue, extending from the base at an acute angle with respect to the base;

a back piece, extending perpendicularly from the base in a same direction as the tongue; and a stop extending perpendicularly from the back piece and towards the tongue; and a plate including;

a top and a bottom surface, a front edge and a back edge, and a groove in the bottom surface, the plate being movable between a first position in which the plate is engaged with the bracket, wherein at least a portion of the front edge of the plate is substantially adjacent to the back piece, and wherein the tongue substantially extends into the groove, and a second position wherein the plate is disengaged from the bracket.

21. A method of securing a seat to a fixed location comprising:

providing a seat that includes a baseplate at the bottom thereof;

installing a bracket and a stop at a predetermined location on a floor, wherein the bracket includes a base, a tongue extending non-perpendicularly from the,base, and a back piece extending perpendicularly from the base, and wherein the stop extends perpendicularly from the back piece and towards the tongue; and inserting the baseplate into the bracket.

22. A quick-release securing mechanism, comprising:

a bracket including:

a base;

a tongue, extending perpendicularly from the base;

a back piece, extending perpendicularly from the base in a same direction as the tongue;

a plate including;

a top and a bottom surface, a front edge and a back edge, and a groove in the bottom surface, the plate being movable between a first position in which the plate is engaged with the bracket, wherein at least a portion of the front edge of the plate is substantially adjacent to the back piece, and wherein the tongue substantially extends into the groove, and a second position wherein the plate is disengaged from the bracket.

* * * * *